US007656098B2

(12) United States Patent
Tseng

(10) Patent No.: US 7,656,098 B2
(45) Date of Patent: Feb. 2, 2010

(54) BRIGHTNESS CONTROL APPARATUS OF LIGHT BULB MODULE

(76) Inventor: Teng-san Tseng, No. 18, Jhensing E. St., Wufong Township, Taichung County 413 (TW)

( * ) Notice: Subject to any disclaimer, the term of this patent is extended or adjusted under 35 U.S.C. 154(b) by 0 days.

(21) Appl. No.: 12/073,799

(22) Filed: Mar. 10, 2008

(65) Prior Publication Data

US 2009/0224687 A1 Sep. 10, 2009

(51) Int. Cl.
*H05B 37/02* (2006.01)

(52) U.S. Cl. ..... 315/291; 315/149; 315/307

(58) Field of Classification Search ..... 315/149, 315/200 R, 207, 224, 272, 291, 301, 307; 361/78, 88, 91.1, 92
See application file for complete search history.

(56) References Cited

U.S. PATENT DOCUMENTS 4,513,239 A * 4/1985 Morishita et al. ..... 322/99
6,339,298 B1 * 1/2002 Chen ..... 315/224
6,724,157 B2 * 4/2004 Kazanov et al. ..... 315/291
7,301,290 B1 11/2007 Tseng ..... 315/299
2002/0113555 A1 * 8/2002 Lys et al. ..... 315/149
2008/0074058 A1 * 3/2008 Lee et al. ..... 315/291
2008/0180037 A1 * 7/2008 Srimuang ..... 315/246

* cited by examiner

*Primary Examiner*—David Hung Vu
*Assistant Examiner*—Tung X Le
(74) *Attorney, Agent, or Firm*—Wang Law Firm, Inc.; Li K. Wang

(57) ABSTRACT

An improved brightness control apparatus of a light bulb module replaces a portion of a conventional light bulb module brightness control apparatus by a signal receiving circuit, an amplification circuit and a failure protection circuit to maintain an even brightness of light emitted by each light bulb of the light bulb module of a lamp, so that the brightness of the light bulbs in the light bulb module will not be too dark or even not lit. The signal receiving circuit is provided for connecting an external remote control device for controlling the light bulb module. If the control circuit fails, the failure protection device can maintain a temporary illumination and an overall aesthetic look of the lamp. When the control circuit is operated normally, the total power consumption of the light bulbs of the light bulb module can comply with the normal rated standard of illumination equipments.

7 Claims, 1 Drawing Sheet

BRIGHTNESS CONTROL APPARATUS OF LIGHT BULB MODULE

BACKGROUND OF THE INVENTION

1. Field of the Invention

The present invention relates to an improved brightness control apparatus of a light bulb module, and more particularly to a brightness control apparatus that overcomes the shortcomings of a conventional control circuit by adding a signal receiving device and a failure protection device to the existing control circuit. The invention not only complies with the requirements of a product having a remote control light bulb module and maintains an even brightness for each light bulb of the light bulb module according to the brightness of the light bulb module adjusted by the remote control signal, but also keeps the total power consumption of the light bulb module in compliance with local laws and regulations for a total normal rated power of an illumination equipment.

2. Description of the Related Art

In recent years, the issue of global energy crisis becomes increasingly serious, and countries propose different energy saving regulations and laws to cope with the insufficient supply to the demand of electric power. At present, the United States establishes related laws and regulations to limit the total normal rated power for indoor illumination equipments and request manufacturers to install a normal rated power breaker before shipping the illumination equipments to the market in order to maintain the total power consumption of the illumination equipments at a standard below the total normal rated power required by the government.

To comply with the foregoing requirements, related manufacturers have developed a brightness control apparatus for a light bulb module as disclosed in U.S. Pat. No. 7,301,290B1 that uses a microcontroller to determine whether or not an illumination equipment exceeds the total normal rated power of 190 W, and a breaker to disconnect the power of the control apparatus if the control circuit exceeds the normal rated power. If one of the control circuits in accordance with the aforementioned patented invention is burned, the whole illumination equipment cannot be used anymore. Users will find such application very inconvenient, or even dangerous if the breaker disconnects the illumination equipment during nighttime.

Therefore, it is an important subject for manufacturers and designers in the related industry to develop a circuit design capable of complying with the requirements of the laws and requirements and controlling an even brightness of each light bulb module while maintaining the existing function of a protection circuit.

SUMMARY OF THE INVENTION

It is a primary objective of the present invention to provide an improved brightness control apparatus of a light bulb module, and the apparatus makes the improvement by using a signal receiving circuit and an amplification circuit to replace a portion of a brightness control apparatus of an existing light bulb module, so that the apparatus not only can adjust the brightness of the light bulb module by the remote control, but also can maintain an even brightness of each light bulb of the light bulb module and a total power consumption of the light bulb module in compliance with the requirements of local laws and regulations for the total normal rated power of the illumination equipments.

Another objective of the present invention is to install a failure protection circuit to the control circuit, so that if the control circuit of the light bulb module fails, each light bulb of the light bulb module remains lit.

To achieve the foregoing objectives, the present invention provides an improved brightness control apparatus, comprising:

a microcontroller, having a power pin, a ground pin and a plurality of pins;

a capacitance step-down rectification circuit, for converting an external alternate current (AC) into a direct current (DC), and supplying the direct current to an overall circuit system for its use;

an output control circuit, for receiving a control signal transmitted from the microcontroller, and controlling a total power consumption of the light bulb of the light bulb module; characterized in that a signal receiving circuit is provided for receiving a phase angle of a received voltage and a current conduction status; and an amplification circuit includes a terminal electrically coupled to the output control circuit for detecting the total power consumption of the light bulb module, and another terminal electrically coupled to the microcontroller.

DETAILED DESCRIPTION OF THE PREFERRED EMBODIMENTS

Figure 1:
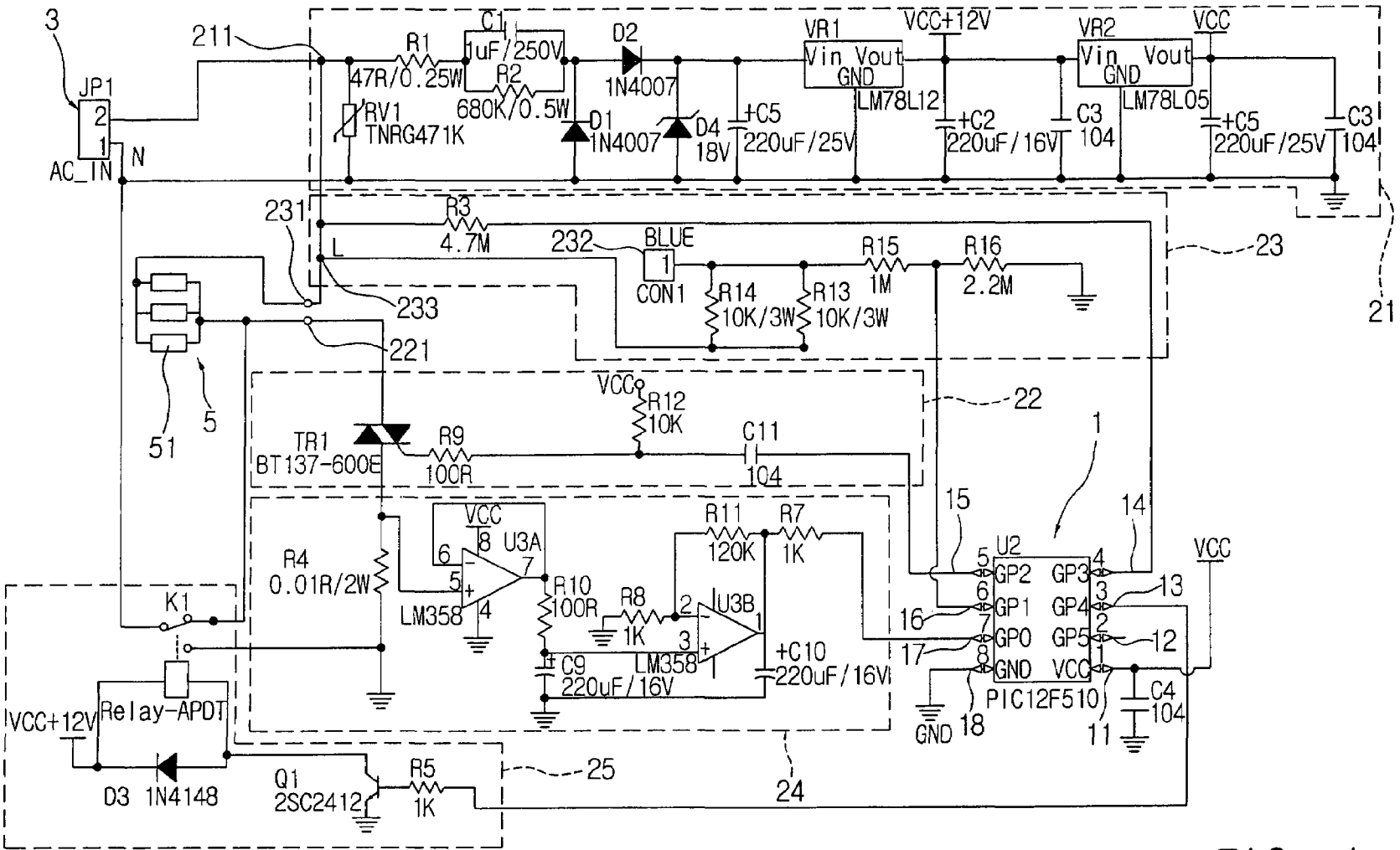
FIG. 1 is a schematic circuit diagram of a control apparatus applied to a light bulb module having a plurality of light bulbs in accordance with the present invention.

In FIG. 1, a preferred embodiment is provided for illustrating the present invention, and it is noteworthy to point out that the preferred embodiment is provided for the purpose of illustration only, but not intended to limit the scope of the invention.

In the preferred embodiment, a brightness control apparatus of a light bulb module comprises the following elements:

A microcontroller 1, which is a microcontroller of Model No. PIC12F510 produced by Microchip Company in this embodiment, includes a power pin 11, a first pin 12, a second pin 13, a third pin 14, a fourth pin 15, a fifth pin 16, a sixth pin 17 and a ground pin 18, and the second pin 13 is in a floating connection while it is not in use.

A capacitance step-down rectification circuit 21 is equipped with a plurality of resistors, a plurality of capacitors, a plurality of diodes, a Zener diode, a surge absorber, a 5-volt regulator IC and a 12-volt regulator IC, for converting an external AC power supply 3 into a DC power, and supplying the DC power to the whole circuit system for its use, and the capacitance step-down rectification circuit 21 is electrically coupled to the power pin 11 of the microcontroller 1.

An output control circuit 22 is equipped with an AC gate, a plurality of resistors and a capacitor. The output control circuit 22 further includes a current output terminal 221 electrically coupled to the light bulb module 5, and the output control circuit 22 is electrically coupled to the fourth pin 15 of the microcontroller 1 for receiving a control signal transmitted from the microcontroller 1.

A signal receiving circuit 23 is equipped with a plurality of resistors and electrically coupled to the third pin 14 and the fifth pin 16 of the microcontroller 1, and the signal receiving circuit 23 is provided for receiving a phase angle of the voltage of the current circuit and a conduction status of the current input terminal 231 or the current output terminal 221, and the current input terminal 231 is electrically coupled to two pins 211 of the power input terminal 3 of the capacitance step-down rectification circuit 21.

An amplification circuit 24 is equipped with an operational amplifier, a plurality of resistors and a plurality of capacitors. A terminal of the amplification circuit 24 is electrically coupled to the output control circuit 23, and another terminal of the amplification circuit 24 is electrically coupled to the sixth pin 17 of the microcontroller 1.

A failure protection circuit 25 is equipped with a relay, a transistor, a diode and a resistor, such that if any circuit of the output control circuit 22, the signal receiving circuit 23 or the amplification circuit 24 fails, the power input terminal 3 directly outputs power to the light bulb module 5, and the failure protection circuit 25 is electrically coupled to the second pin 13 of the microcontroller 1.

When the present invention is applied to a lamp as shown in FIG. 1, the improvement resides on that the light bulb module 5 of the lamp includes three light bulbs 51 with the power of 70 W each, and users can install the brightness control apparatus of the invention to the lamp, so that the setup and control of the microcontroller 1 and the control of the aforementioned five control circuits can detect the quantity of light bulbs 51 of the light bulb module 5 and determine the voltage by the microcontroller 1 by the amplification circuit 24, and maintain the power between the current input terminal 231 and the current output terminal 221 at a standard normal rated power below 190 watts. Each light bulb 51 of the light bulb module 5 emits light with an even brightness by 63 watt.

Unlike the traditional brightness control apparatus of a light bulb module, the improved control circuit of the invention is connected to an external radio frequency remote control device by a BLUE-terminal 232 of the signal receiving circuit 23 for transmitting a radio frequency signal to the microcontroller 1 to control the brightness of the light bulbs 51 of the light bulb module 5, while controlling the power below the standard normal rated power of 190 watts. If a L-terminal 233 of the signal receiving circuit is coupled to the current input terminal 231, the cost for the required circuits will be lower, and the execution procedure and coding of the program for the microcontroller 1 will be simpler and easier.

The failure protection circuit 25 of the improved control circuit is provided for outputting power directly from the power input terminal to the light bulb module through the failure protection circuit if any one of the output control circuit 22, the signal receiving circuit 23 and the amplification circuit 24 fails, such that the light bulb module 5 remains lit, even if the control circuit fails. A lamp of this sort can maintain the required illumination without losing the overall aesthetic look of the lamp. Further, no change of the design is involved to comply with the total standard normal rated power for the illumination equipments, and thus the invention can save cost.

In summation of the description above, the present invention has the advantage of maintaining an even brightness of each light bulb of the light bulb module by the control of the brightness control apparatus, so that the brightness of the bulbs of the light bulb module will not be too dark or not lit. Further, the brightness control apparatus can operate with an external radio frequency remote control device to facilitate the control of brightness, and the failure protection circuit can maintain a temporary illumination effect and an overall aesthetic look of the lamp. If the brightness control circuit is operated normally, the total power consumption of the light bulbs of the light bulb module can meet the requirements of the standard normal rated power specified by local laws and regulations of the illumination equipments.

What is claimed is:

1. An improved brightness control apparatus of a light bulb module, comprising:

a microcontroller, having a power pin, a ground pin and a plurality of pins;

a capacitance step-down rectification circuit, for converting an external alternate current into a direct current, and supplying said direct current for the use of an overall circuit system;

an output control circuit, for receiving a control signal transmitted from said microcontroller, and controlling a total power consumption of said light bulb of said light bulb module, characterized in that a signal receiving circuit is provided for receiving a phase angle of a received voltage and a current conduction status;

an amplification circuit includes a terminal electrically coupled to said output control circuit for detecting the total power consumption of said light bulb module, and another terminal electrically coupled to said microcontroller; and a failure protection circuit installed between said light bulb module and said amplification circuit, for preventing an output from said power input terminal to said failure protection circuit when any one of said output control circuit, said signal receiving circuit and said amplification circuit fails, and said failure protection circuit is electrically coupled to said microcontroller.

2. The improved brightness control apparatus of a light bulb module as recited in claim 1, wherein said signal receiving circuit operates with an external radio frequency remote control device for controlling a current conduction status of said light bulb module current.

3. The improved brightness control apparatus of a light bulb module as recited in claim 1, wherein said voltage step-down circuit is equipped with a plurality of resistors, a plurality of capacitors, a plurality of diodes, a Zener diode, a surge absorber, a 5-volt regulator IC and a 12-volt regulator IC.

4. The improved brightness control apparatus of a light bulb module as recited in claim 1, wherein said output control circuit is equipped with an AC gate, a plurality of resistors and a capacitor.

5. The improved brightness control apparatus of a light bulb module as recited in claim 1, wherein said signal receiving circuit is equipped with a plurality of resistors.

6. The improved brightness control apparatus of a light bulb module as recited in claim 1, wherein said amplification circuit is equipped with an operational amplifier, a plurality of resistors and a plurality of capacitors.

7. The improved brightness control apparatus of a light bulb module as recited in claim 1, wherein said failure protection circuit is equipped with a relay, a transistor, a diode and a resistor.

* * * * *